US005803755A

United States Patent [19]

Kuchar et al.

[11] Patent Number: 5,803,755

[45] Date of Patent: Sep. 8, 1998

[54] ELECTRICAL CONNECTION FOR TRACK LIGHTING

[75] Inventors: James Kuchar, Fall River; Anthony Donato, Wellesley; Mete Kantar, Fall River, all of Mass.

[73] Assignee: The Genlyte Group Incorporated, Union, N.J.

[21] Appl. No.: 967,072

[22] Filed: Nov. 10, 1997

Related U.S. Application Data

[63] Continuation of Ser. No. 729,775, Oct. 8, 1996, abandoned, which is a continuation of Ser. No. 331,714, Oct. 31, 1994, abandoned.

[51] Int. Cl.[6] ..... H01R 25/00

[52] U.S. Cl. ..... 439/110; 439/856

[58] Field of Search ..... 439/110, 116, 439/117, 112, 120, 121, 858, 861, 830, 856

[56] References Cited

U.S. PATENT DOCUMENTS

| | | | |
|---|---|---|---|
| 2,031,542 | 2/1936 | Manchester | 439/110 |
| 3,524,050 | 8/1970 | Gustine | 439/110 |
| 4,032,208 | 6/1977 | Berkenhoff | 339/88 |
| 4,087,147 | 5/1978 | Silvestris et al. | 339/21 |
| 4,096,349 | 6/1978 | Donato | 174/68 |
| 4,218,108 | 8/1980 | El Mouchi | 339/82 |
| 4,414,617 | 11/1983 | Galindo | 362/404 |
| 4,414,627 | 11/1983 | Galindo . | |
| 4,676,567 | 6/1987 | Mouchi | 439/207 |
| 4,752,244 | 6/1988 | Kuhl et al. | 439/858 |
| 4,778,397 | 10/1988 | Contant et al. | 439/116 |
| 4,822,292 | 4/1989 | Thayer et al. | 439/207 |
| 4,881,907 | 11/1989 | Bergman et al. | 439/111 |
| 4,919,625 | 4/1990 | Coutre . | |
| 5,217,298 | 6/1993 | Jackson et al. | 362/226 |
| 5,259,774 | 11/1993 | Gabrius | 439/110 |

FOREIGN PATENT DOCUMENTS

| | | | |
|---|---|---|---|
| 1435160 | 3/1966 | France | 439/110 |
| 2087168 | 5/1982 | United Kingdom | 439/110 |

OTHER PUBLICATIONS

Trade brochure Sightline™, Edison Price, pp. 8–8.1, Edison Price Lighting, New York (1994). No month.

Brochure (Edison Price Lighting, Sightlines, New York, NY, pg.), 1994.

*Primary Examiner*—Neil Abrams

*Assistant Examiner*—Katrina Davis

*Attorney, Agent, or Firm*—Hopgood, Calimafde, Kalil & Judlowe, LLP

[57] ABSTRACT

Described is an improved electrical connection suitable for track lighting which is comprised of a novel, formed conductive buss structure having a hairpin curve shape cross-section forming a groove for firmly holding a conductive blade to provide physical and electrical integrity of the connection thereby.

8 Claims, 7 Drawing Sheets

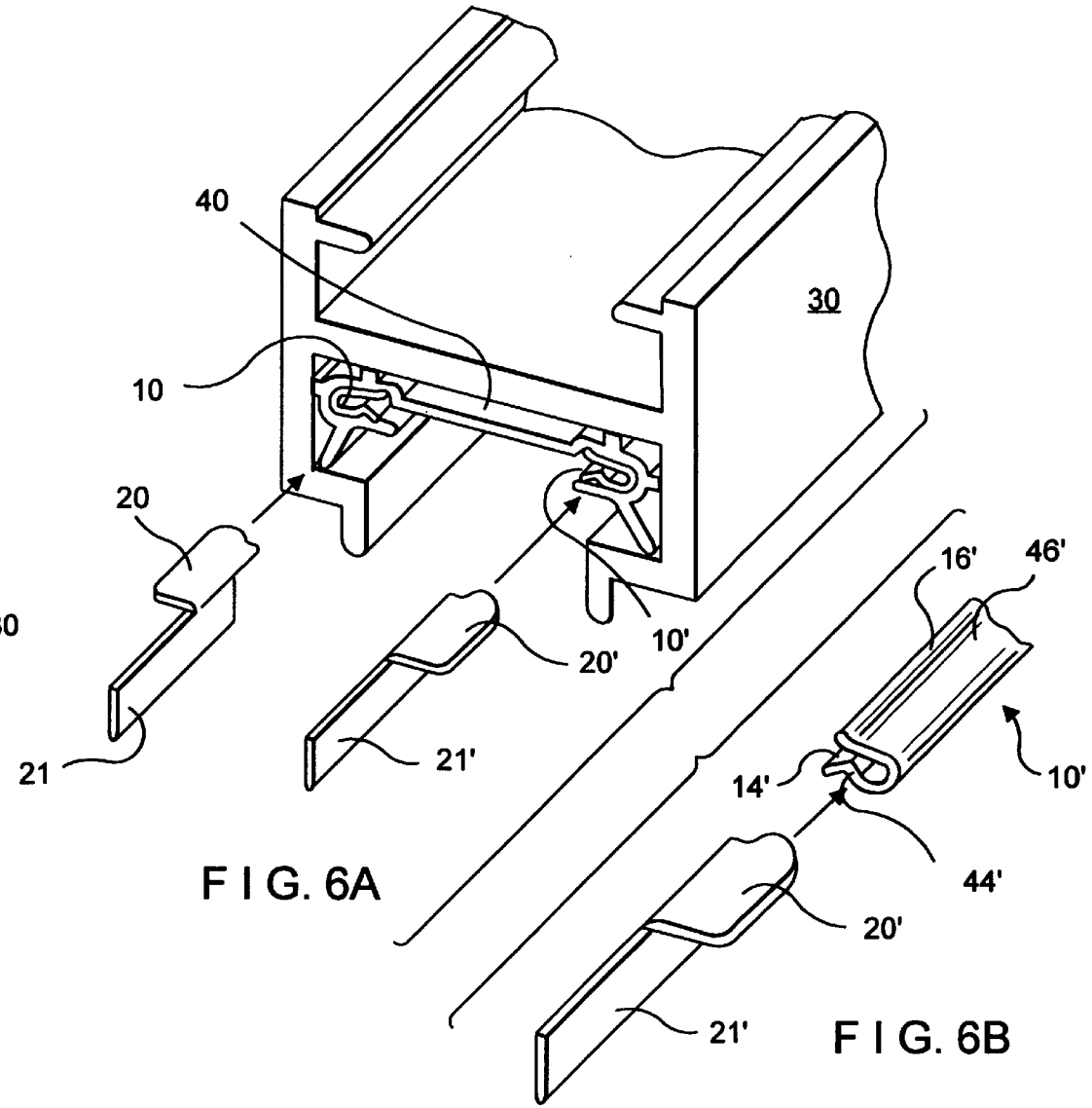
FIG. 6A
FIG. 6B
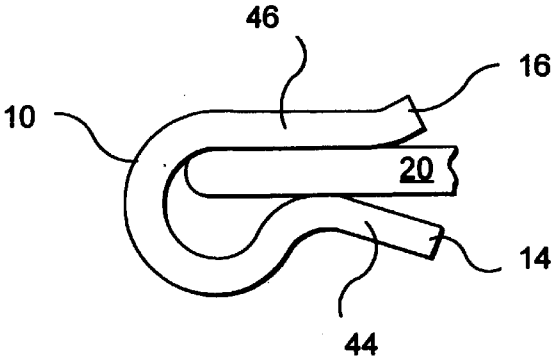
FIG. 4
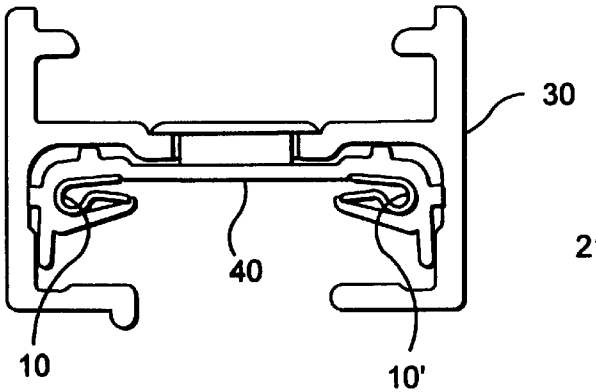
FIG. 5

| CONTACT | mV INITIAL | CYCLES mV 5 | CYCLES mV 15 | CYCLES mV 25 | DELTA 25-INITIAL |
|---|---|---|---|---|---|
| 1 | 1.41 | 1.31 | 1.41 | 1.51 | 0.10 |
| 2 | 1.21 | 1.41 | 2.41 | 2.01 | 0.80 |
| 3 | 1.21 | 1.41 | 1.71 | 1.31 | 0.10 |
| 4 | 0.31 | 0.41 | 1.31 | 1.11 | 0.80 |
| 5 | 2.01 | 1.61 | 1.61 | 1.71 | -0.30 |
| 6 | 2.11 | 1.41 | 1.41 | 1.31 | -0.80 |
| 7 | 0.31 | 0.81 | 1.01 | 1.21 | 0.90 |
| 8 | 0.21 | 0.41 | 0.71 | 0.91 | 0.70 |
| 9 | 1.11 | 0.91 | 1.01 | 2.11 | 1.00 |
| 10 | 0.71 | 0.71 | 1.11 | 4.51 | 3.80 |
| 11 | 2.11 | 2.21 | 2.11 | 3.61 | 1.50 |
| 12 | 1.01 | 1.31 | 1.71 | 2.91 | 1.90 |
| 13 | 1.01 | 0.71 | 0.91 | 0.91 | -0.10 |
| 14 | 1.21 | 0.71 | 0.91 | 1.01 | -0.20 |
| 15 | 1.41 | 2.11 | 3.01 | 4.01 | 2.60 |
| 16 | 1.51 | 1.71 | 2.11 | 2.51 | 1.00 |
| 17 | 2.51 | 2.81 | 3.01 | 3.01 | 0.50 |
| 18 | 1.11 | 0.91 | 1.31 | 1.31 | 0.20 |
| 19 | 0.51 | 0.81 | 1.01 | 1.21 | 0.70 |
| 20 | 0.61 | 1.31 | 2.51 | 2.91 | 2.30 |
| | | | | | |
| MEAN | 1.18 | 1.25 | 1.62 | 2.06 | 0.83 |
| STANDARD DEVIATION | 0.65 | 0.63 | 0.70 | 1.10 | |
| MIN. | 0.21 | 0.41 | 0.71 | 0.91 | |
| MAX. | 2.51 | 2.81 | 3.01 | 4.51 | |
| RANGE | 2.30 | 2.40 | 2.30 | 3.60 | |
| MEDIAN | 1.16 | 1.31 | 1.41 | 1.61 | |
| VARIANCE | 0.42 | 0.39 | 0.49 | 1.21 | |
| MODE | 1.21 | 1.31 | 1.01 | 1.31 | |
| SUM | 23.60 | 25.00 | 32.30 | 41.10 | |
| COUNT | 20.00 | 20.00 | 20.00 | 20.00 | |

FIG. 7A

| CONTACT | mV INITIAL | CYCLES mV 5 | mV 15 | mV 25 | DELTA 25-INITIAL |
|---|---|---|---|---|---|
| 1 | 4.45 | 4.45 | 5.75 | 5.15 | 0.70 |
| 2 | 6.95 | 7.05 | 7.05 | 6.35 | -0.60 |
| 3 | 4.45 | 5.75 | 24.85 | 49.25 | 44.80 |
| 4 | 3.45 | 10.75 | 26.45 | 55.15 | 51.70 |
| 5 | 6.05 | 11.45 | 11.75 | 29.45 | 23.40 |
| 6 | 5.05 | 7.75 | 16.25 | 49.25 | 44.20 |
| 7 | 6.15 | 4.25 | 5.75 | 8.15 | 2.00 |
| 8 | 8.85 | 6.25 | 5.35 | 5.15 | -3.70 |
| 9 | 3.55 | 3.15 | 4.05 | 5.35 | 1.80 |
| 10 | 8.15 | 5.95 | 5.95 | 6.85 | -1.30 |
| 11 | 4.35 | 6.25 | 17.25 | 40.25 | 35.90 |
| 12 | 5.75 | 5.55 | 5.95 | 5.65 | -0.10 |
| 13 | 4.85 | 5.85 | 11.55 | 22.95 | 18.10 |
| 14 | 6.35 | 7.25 | 11.15 | 21.45 | 15.10 |
| 15 | 4.25 | 19.25 | 26.85 | 41.45 | 37.20 |
| 16 | 8.45 | 12.25 | 34.25 | 55.25 | 46.80 |
| 17 | 12.75 | 20.25 | 39.45 | 42.55 | 29.80 |
| 18 | 7.85 | 28.05 | 47.15 | 19.55 | 11.70 |
| 19 | 4.65 | 8.95 | 9.25 | 19.95 | 15.30 |
| 20 | 4.95 | 4.65 | 14.75 | 48.35 | 43.40 |
| | | | | | |
| MEAN | 6.07 | 9.26 | 16.54 | 26.88 | 20.81 |
| STANDARD DEVIATION | 2.26 | 6.38 | 12.59 | 19.04 | |
| MIN. | 3.45 | 3.15 | 4.05 | 5.15 | |
| MAX. | 12.75 | 28.05 | 47.15 | 55.25 | |
| RANGE | 9.30 | 24.90 | 43.10 | 50.10 | |
| MEDIAN | 5.40 | 6.65 | 11.65 | 22.20 | |
| VARIANCE | 5.11 | 40.76 | 158.49 | 362.52 | |
| MODE | 4.45 | 6.25 | 5.75 | 5.15 | |
| SUM | 121.30 | 185.10 | 330.80 | 537.50 | |
| COUNT | 20 | 20 | 20 | 20 | |

FIG. 8A

ELECTRICAL CONNECTION FOR TRACK LIGHTING

RELATED APPLICATIONS

This is a continuation of application Ser. No. 729,775, filed Oct. 8, 1996, abandoned, which is a continuation of Ser. No. 331,714, filed Oct. 31, 1994 aban.

BACKGROUND OF THE INVENTION

1. Field of Invention

The present invention relates to track lighting systems. More particularly, the present disclosure describes an improved electrical connection suitable for track lighting comprised of a novel conductive buss structure which, with its paired contact blade, dramatically improves the electrical integrity of connections in track lighting.

2. Description of the Related Art

Connection systems for track lighting are known such as U.S. Pat. No. 4,032,208 which describes a connector for installation in C-shaped tracks and U.S. Pat. No. 4,087,147 which describes a connector comprised of a non-conductive, multi-cavity housing. Devices for facilitating electrical connections in track lighting are available in the art. For instance, U.S. Pat. No. 4,096,349 describes a flexible electrical connector for diverging light tracks, U.S. Pat. No. 4,218,108 describes a connecting component which allows pivot action when introduced into the supporting track and U.S. Pat. No. 4,414,617 describes connectors adapted for track lighting in suspended ceilings.

A prevalent problem which exists in conventional connectors for track lighting is the maintenance of electrical integrity in the conductive components that make up the electrical connection. To bias metal conductive elements together to form an electrical connection, conventional track lighting connectors rely on plastic holders such as those disclosed in U.S. Pat. Nos. 4,676,567, 4,778,397, 4,822,292, 4,919,625 and 5,217,298. Typically, a rod-shaped metal buss is retained by a plastic holding structure such as described in U.S. Pat. No. 5,259,774.

For example, FIG. 3 in the present drawings shows an end view of a prior art plastic connector 41 holding three solid, round metal busses 11, 11' and 11". As shown, plastic wall portions 43 and 45 of plastic connector 41 exert opposing forces to hold therebetween a conventional metal contact blade 22 to establish an electrical contact between metal blade 22 and round metal buss 11. Conventional plastic materials used in such connection systems are subject to a phenomenon known as "creep" which is a gradual and undesirable flow of the plastic over time due to extended periods of exposure to elevated operating temperatures.

As the connectors age with use, the force exerted by the plastic holders gradually diminish and the bias or pressure placed on the metal conductors steadily decreases. The result is a non-stable electrical connection between the metal contacts which causes arcing, out-of-spec voltage drops, increases in resistance and increases in temperature rise. In essence, known track lighting devices have a number of deficiencies regarding the ability to maintain physical and electrical integrity between metal conductive components in the connection system. A need exists in the art for a more efficient connecting structure which maintains consistent and stable electrical integrity.

OBJECTS OF THE INVENTION

Accordingly, it is an object of this invention to provide an improved electrical connection for track lighting which enhances the electrical integrity between conductive components in the electrical connections.

Another object of this invention is to provide a novel electrical connection with improved electrical integrity which provides sustained contact force between electrical conductors used for carrying electric current in a track lighting system.

A further object of this invention is to provide a stable electrical connection for track lighting which provides consistent and reliable electrical integrity over a prolonged lifetime.

Yet another object of this invention is to provide a stable electrical connection for track lighting comprised of a novel, formed conductive buss structure and a conductive blade structure which contribute to an increased contact surface area for enhanced conductance and reduced resistance.

These and other objects will be apparent in the following description.

SUMMARY OF THE INVENTION

The present invention is an improved electrical connection for track lighting comprised of a track housing for holding at least one formed conductive buss structure positioned within the track housing, with the buss structure having a substantially curved wall portion and an opposing, substantially flat wall portion. The substantially curved wall portion and the substantially flat wall portion are normally biased towards each other and form a groove therebetween. The invention is further comprised of at least one electrically conductive contact blade which is held firmly between the substantially curved wall portion and the substantially flat wall portion of the conductove buss structure to provide an electric connection for the track lighting.

The novel electrical connection also comprises an insulating track liner positioned within the track housing. The track liner has at least one recess in which the formed conductive buss structure is positioned. The present connection can also comprise an elongated buss structure having a hairpin curve shape cross-section. This buss with a hairpin curve shape cross-section can have a substantially curved wall portion and a substantially flat wall portion which are normally biased towards each other and form a groove therebetween for firmly holding at least one electrically conductive contact blade.

The improved electrical connection for track lighting can also comprise a plurality of formed conductive buss structures and a plurality of electrically conductive blades, each of the blades clamped into grooves formed in the elongated structures with hairpin curve shape cross-sections.

BRIEF DESCRIPTION OF THE DRAWINGS

FIG. 4 depicts an enlarged end view of the preferred conductive buss structure of the present invention.

FIG. 5 shows another embodiment of the present invention having two of the novel conductive buss structures such as depicted in FIG. 4 within respective recesses in a track liner.

FIG. 6A is a perspective view showing a pair of the inventive conductive buss structures disposed within an insulating track liner with arrows indicating direction of insertion of a pair of conductive contact blades into respective busses.

FIG. 6B depicts an enlarged view of one of the conductive buss structures and one of the conductive contact blades shown in FIG. 6A.

FIGS. 7A and 7B respectively tabulate and graphically depict the results of voltage drop tests on the present invention.

FIGS. 8A and 8B respectively tabulate and graphically depict the results of comparative voltage drop tests on prior art plastic connectors such as depicted in FIG. 3.

DETAILED DESCRIPTION OF THE INVENTION

Figure 1:
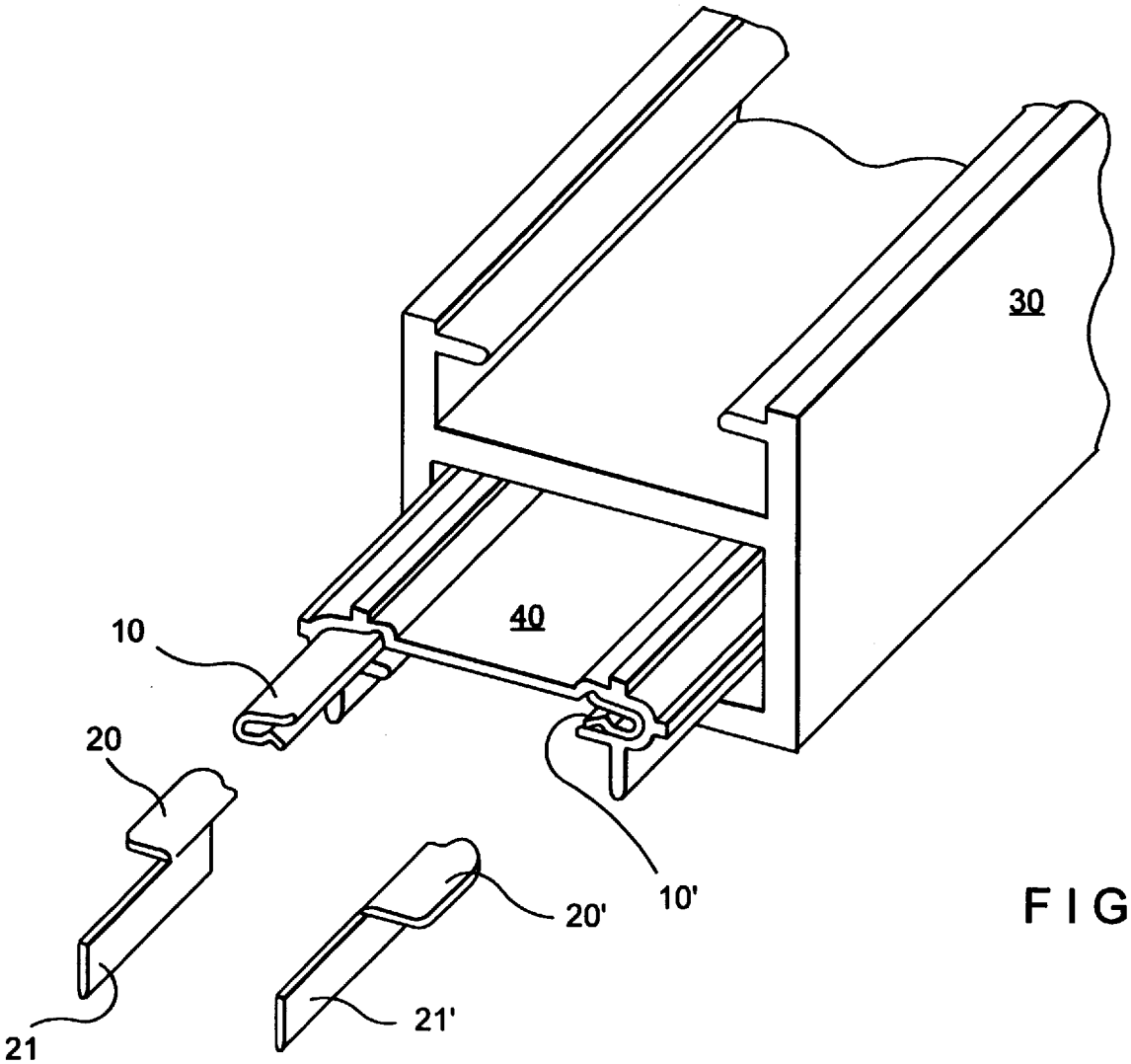
FIG. 1 is a perspective view of the present invention showing the novel conductive buss structure extending from a track liner disposed within a section of track.

The improved electrical connection for track lighting is shown in FIG. 1 and is depicted as being comprised of a formed, metal conductive buss structure 10 which accepts an electrically conductive, metal contact blade 20. As shown, conductive contact blade 20 forms the terminal portion of a metal conducting member 21. The embodiment shown in FIG. 1 is designed for use with an extruded, track housing 30, having disposed therein an insulating track liner 40.

Figure 2:
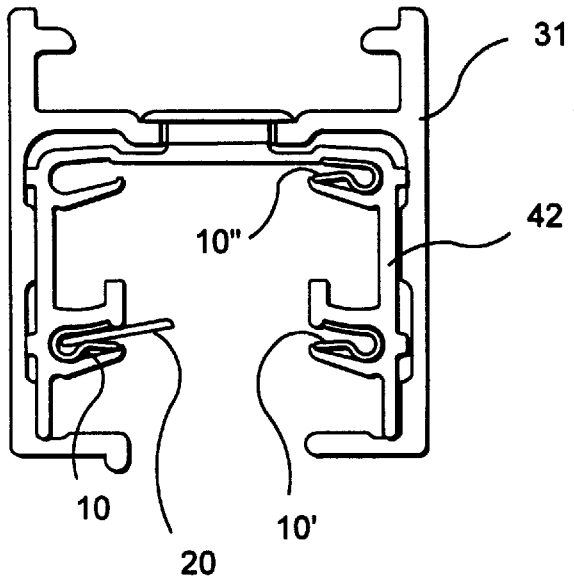
FIG. 2 is an end view of one embodiment of the present invention showing the use of three novel conductive buss structures within a track liner having multiple recesses.

FIG. 2 depicts an end view of one embodiment of the present invention showing three conductive buss structures 10, 10' and 10" within recesses in track liner 42, all disposed within a section of track 31. An end view of contact blade 20 is shown clamped between the two opposing walls of buss structure 10. Blade 20 and buss structures 10, 10' and 10" are made of suitable conducting metals, track liner 42 is comprised of a suitable insulating, non-conducting thermoplastic, and track 31 is extruded from a light weight metal, all materials well known to those skilled in the art.

Figure 3:
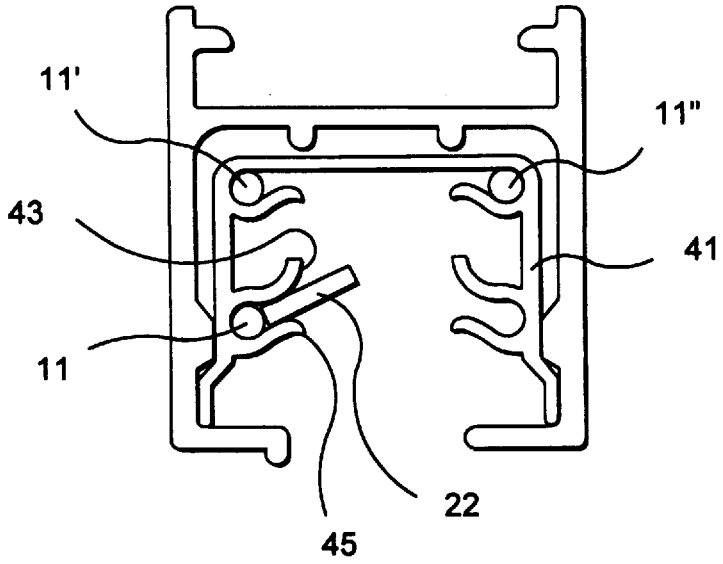
F I G. 3 PRIOR ART
FIG. 3 is an end view of a prior art plastic connector holding three solid, round metal busses.

FIG. 3 is a comparative end view of a known plastic connector 41 holding solid, round metal busses 11, 11' and 11". An end view of metal contact blade 22 is shown sandwiched in biased contact between the two opposing plastic wall portions 43 and 45 which exert opposing forces to hold therebetween metal contact blade 22 in electrical contact with round metal buss 11.

FIG. 4 shows an enlarged end view of conductive buss 10. As depicted, conductive buss 10 has a hairpin curve shape cross-section having a substantially curved wall portion 44 and a substantially flat wall portion 46, which have lead-in portions 14 and 16, respectively. An end view of blade 20 is shown disposed in biased contact between the two opposing wall portions 44 and 46 of buss structure 10. This novel arrangement has many advantages including ease of insertion of blade 20 into the recess provided by the walls of buss 10 through lead-in portions 14 and 16.

A significant advantage of the structure depicted in FIG. 4 is the ability to exert force or pressure with the substantially curved wall portion 44 on blade 20, biasing blade 20 against opposing substantially flat wall portion 46 to provide a large surface area of electrical contact. These features allow maximum electrical integrity in a stable, consistent manner. Furthermore, this stable, consistent electrical integrity is preserved even after extended periods of use because the blade is held by the metal (non-plastic) buss, rather than the plastic insulator.

FIG. 5 shows an embodiment of the present invention having two conductive busses 10 and 10' disposed in recesses of track liner 40. The biased electrical contact made by the two arms of buss 10 on an inserted conductive blade is not dependent on additional materials such as thermoplastics. Non-conducting materials such as comprising thermoplastic track liner 40 are used only to electrically insulate and initially position metal busses 10 and 10'. The novel buss' physical structure and its composition of metal, dramatically improves the electrical integrity of the conducting components in the connection within the track lighting.

Those skilled in the art could develop variations in the physical arrangement of the buss' hairpin curve shape cross-section without deviating from the scope of the present invention. The key elements dislosed herein which contribute to enhancing electrical integrity of track lighting connections are the increase in surface area for electrical contact and the use of the conductive buss to provide bias between the electrical contacts. Suitable metals, alloys or their functional substitutes are known to those skilled in the art, and all such alternatives are considered within the scope of this disclosure.

FIG. 6A depicts the positioning of a pair of electrically conductive blades 20 and 20' into respective buss structures 10 and 10'. The two arrows in FIG. 1 indicate the direction of insertion of the conductive blades. FIG. 6B depicts conductive buss 10' as being an elongated structure with a hairpin curve shape cross-section comprised of a substantially curved wall portion 44' and a substantially flat wall portion 46'. The arrow in FIG. 6B indicates the direction of insertion of blade 20' of conducting member 21' into the groove formed by walls 44' and 46' of bus 10'.

The integrity of the invention was tested by measuring the voltage drop and temperature rise between the electrically conductive buss and conductive metal blade over time. The invention was life-cycle tested under conditions which simulate end product usage. The voltage drop and temperature were measured periodically throughout the testing period. The improvement was realized by comparing the change in voltage drop and temperature rise between the new invention and existing systems at the completion of the testing period. The new invention maintained a low electric resistance and low temperature rise throughout the testing period.

EXAMPLE

COMPARATIVE TESTING THE PRESENT INVENTION

The travel of electrical current is predominantly a surface phenomenon. Thus, an increase in surface area of the contact established between a buss and blade will increase the profile and flow of current, and reduce resistance. This premise was comparatively tested with the novel buss structure of the present invention and the results are set forth below.

Electrical contact testing was based on the IEC standard 598-1. Testing was conducted on the present connection initially at 0 cycles and then after 5, 15 and 25 cycles. Each life cycle represented a 30-minute incubation of the connection in an oven set at a temperature of 100° C. to simulate end use. After the requisite cycles, samples were cooled to ambient temperature for 30 minutes, followed by measurements taken at a controlled current of 20 amps.

Figure 7B:
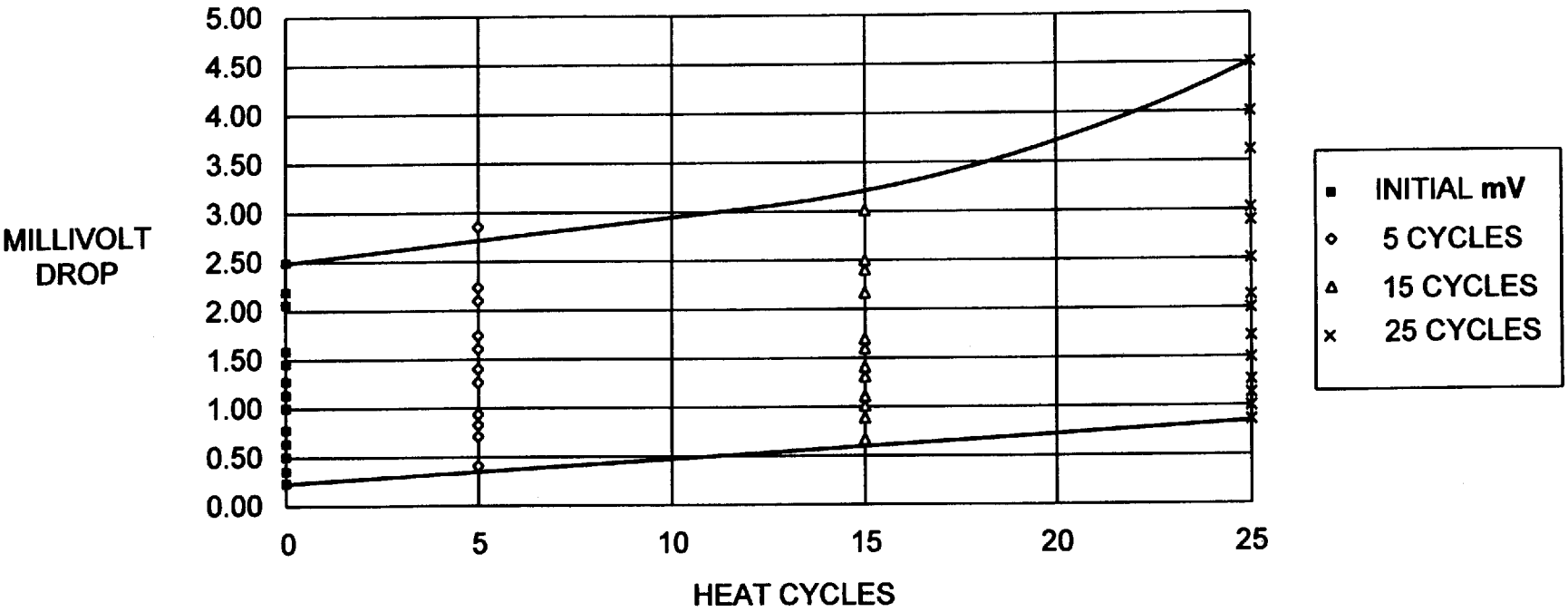

With voltage being directly proportional to resisitance under Ohm's law (V=IR), the increase in voltage or increase in DELTA V over time is an indication of increased resistance. The extreme right hand column in FIG. 7A tabulates the DELTA or difference between the initial mV reading (0 cycles) and the final mV reading after 25 cycles taken from 20 samples of the present invention. Negative values indicate a decrease in voltage and positive values indicate an increase. The mean DELTA (25 CYCLES—INITIAL) for samples of the present invention was 0.83 mV.

Figure 8B:
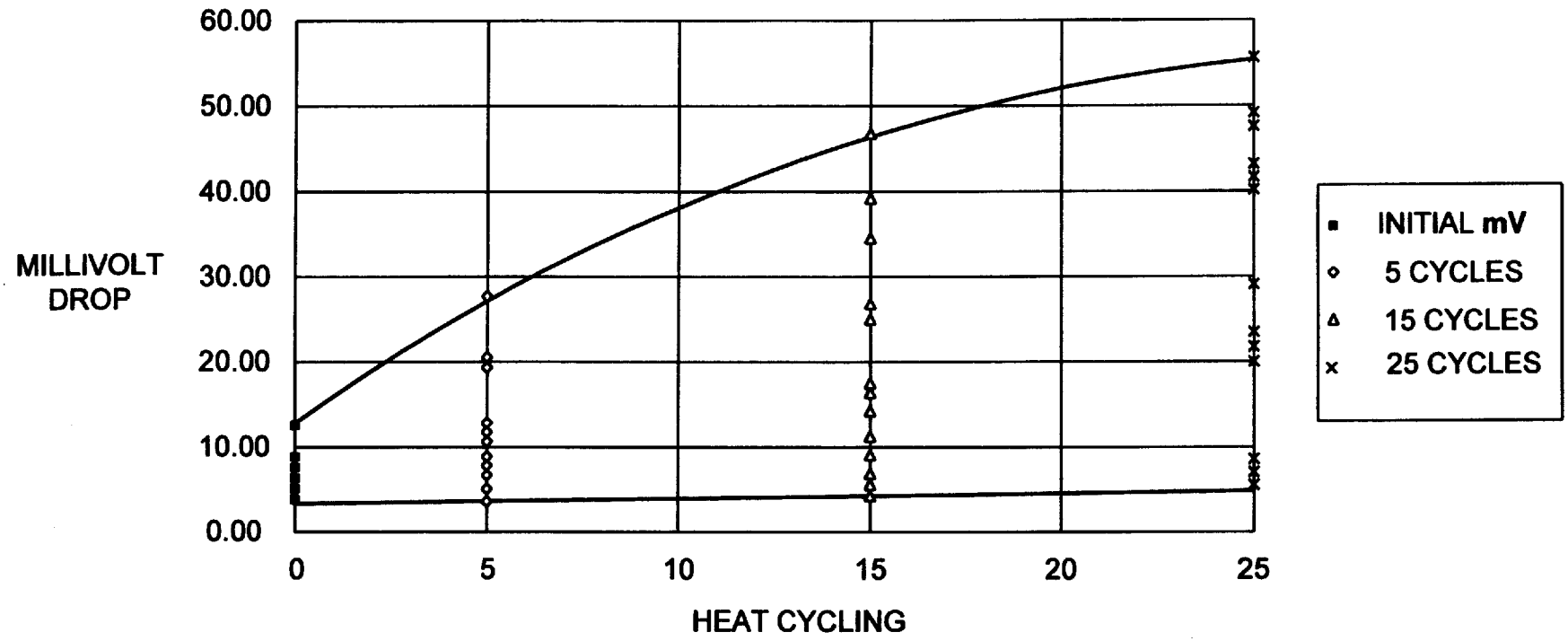

The above procedure was repeated on prior art plastic connectors such as depicted in FIG. 3. FIG. 8A indicates that the mean DELTA (25 CYCLES—INITIAL) for samples of the prior art devices was 20.81 mV. As these results show, the presently disclosed connectors remain stable over simulated time periods of end use with dramatically lower increases in mean resistance.

What is claimed is:

1. An improved electrical connection for track lighting, comprising:

a track housing for holding at least one conductive buss;

at least one formed, conductive buss structure positioned within said track housing, said buss structure having a substantially curved wall portion and an opposing, substantially flat wall portion, said substantially curved wall portion and said substantially flat wall portion being normally biased towards each other and forming a groove therebetween; and said buss structure adapted to engage at least one electrically conductive contact, wherein said contact fits into said groove and is held firmly between said substantially curved wall portion and said substantially flat wall portion of said conductive buss structure to provide an electrical connection for said track lighting.

2. The improved electrical connection for track lighting of claim 1 further comprising an insulating track liner positioned within said track housing, said track liner having at least one recess, and wherein said at least one formed conductive buss structure is positioned within said recess of said track liner.

3. An improved electrical connection for track lighting, comprising:

a track housing for holding a plurality of conductive busses;

a plurality of formed conductive buss structures positioned within said track housing, said buss structures each having a substantially curved wall portion and an opposing, substantially flat wall portion, said substantially curved wall portion and said substantially flat wall portion being normally biased towards each other and forming a groove therebetween; and said plurality of buss structures adapted to engage a plurality of electrically conductive contacts, each of said contacts clamped into said groove formed by said substantially flat wall portion and said substantially curved wall portion, and said each contact held thereby.

4. The improved electrical connection for track lighting of claim 3 further comprising an insulating track liner positioned within said track housing, said track liner having at least three recesses, and wherein three formed conductive buss structures are positioned within said recesses of said track liner.

5. An improved electrical connection for track lighting, comprising:

a track housing for holding at least one conductive buss;

at least one formed, conductive buss structure positioned within said track housing, said buss structure having a substantially curved wall portion and an opposing, substantially flat wall portion, said substantially curved wall portion and said substantially flat wall portion being normally biased towards each other and forming a groove therebetween; and a contact means for providing an electrical connection with said buss structure for said track lighting.

6. An improved electrical connection for track lighting, comprising:

a track housing for holding a plurality of conductive busses;

a plurality of formed, conductive buss structures positioned within said track housing, said buss structures each having a substantially curved wall portion and an opposing, substantially flat wall portion, said substantially curved wall portion and said substantially flat wall portion being normally biased towards each other and forming a groove therebetween; and contact means for providing electrical connection with said buss structures for said track lighting.

7. An improved electrical connection for track lighting, comprising:

a track housing for holding at least one conductive buss;

at least one conductive buss structure positioned within said track housing, said buss structure having a first substantially curved wall portion; an opposing, substantially flat wall portion; and an intermediate second substantially curved wall portion extending between the contiguous with said first substantially curved wall portion and said flat wall portion, said first substantially curved wall portion and said substantially flat wall portion being normally biased toward each other and forming a narrow opening therebetween to receive a contact therein;

wherein the contact is inserted into said opening and is held firmly between said first substantially curved wall portion and said substantially flat wall portion of said conductive buss structure, thereby to provide a secure and reliable electrical connection for said track lighting.

8. The electrical connection of claim 7, in which said buss structure further includes first and second outwardly diverging end lead sections respectively extending from the free ends of said flat wall portion and said first substantially curved wall sections.

* * * * *